US009093753B2

(12) United States Patent
Jung et al.

(10) Patent No.: US 9,093,753 B2
(45) Date of Patent: Jul. 28, 2015

(54) ARTIFICIAL MAGNETIC CONDUCTOR

(75) Inventors: Young Bae Jung, Daejeon (KR); Soon Young Eom, Daejeon (KR); Soon Ik Jeon, Daejeon (KR); Young Joong Yoon, Seoul (KR); Jihwan Ahn, Seoul (KR); Ji Hwan Yoon, Seoul (KR)

(73) Assignee: INDUSTRY-ACADEMIC COOPERATION FOUNDATION, YONSEI UNIVERSITY, Seoul (KR)

( * ) Notice: Subject to any disclaimer, the term of this patent is extended or adjusted under 35 U.S.C. 154(b) by 1171 days.

(21) Appl. No.: 12/978,018

(22) Filed: Dec. 23, 2010

(65) Prior Publication Data

US 2011/0181490 A1 Jul. 28, 2011

(30) Foreign Application Priority Data

Jan. 22, 2010 (KR) ..... 10-2010-0006191
Mar. 25, 2010 (KR) ..... 10-2010-0026784

(51) Int. Cl.
*H01Q 15/02* (2006.01)
*H01Q 15/00* (2006.01)

(52) U.S. Cl.
CPC ..... *H01Q 15/008* (2013.01)

(58) Field of Classification Search
CPC . H01Q 1/38; H01Q 15/0006; H01Q 15/0013; H01Q 15/008; H01Q 15/02; H01Q 15/14; H01Q 15/23; H01Q 19/18; H01Q 19/185; H01Q 9/00; H01Q 9/27
USPC ..... 343/909, 846, 770, 700 MS
See application file for complete search history.

(56) References Cited

U.S. PATENT DOCUMENTS

| | | | | |
|---|---|---|---|---|
| 6,483,480 | B1 * | 11/2002 | Sievenpiper et al. | 343/909 |
| 6,512,494 | B1 * | 1/2003 | Diaz et al. | 343/909 |
| 6,525,693 | B2 | 2/2003 | Ugge' | |
| 6,917,343 | B2 | 7/2005 | Sanchez et al. | |
| 8,325,104 | B2 * | 12/2012 | Sim et al. | 343/909 |
| 2003/0071763 | A1 * | 4/2003 | McKinzie et al. | 343/909 |
| 2009/0201212 | A1 | 8/2009 | Sim et al. | |
| 2009/0201220 | A1 | 8/2009 | Kim et al. | |
| 2010/0001080 | A1 | 1/2010 | Sim et al. | |
| 2010/0127943 | A1 * | 5/2010 | Inoue et al. | 343/702 |

FOREIGN PATENT DOCUMENTS

| | | | |
|---|---|---|---|
| KR | 10-0753830 | B1 | 8/2007 |
| KR | 10-2008-0039178 | A | 5/2008 |
| KR | 10-2009-0065257 | A | 6/2009 |

* cited by examiner

*Primary Examiner* — Dameon E Levi
*Assistant Examiner* — Hasan Islam
(74) *Attorney, Agent, or Firm* — Rabin & Berdo, P.C.

(57) ABSTRACT

An artificial magnetic conductor includes a conductor layer, a ground layer, and a via. The conductor layer is formed in a first direction and includes a plurality of grid cells. The ground layer is formed in a second direction that is opposite to the first direction and generates a lower frequency than that of an artificial magnetic conductor including a plurality of grid cells having the same size as that of the plurality of grid cells of the conductor layer and a conductor plate having a form that is not modified. The via is formed between the conductor layer and the ground layer to electrically connect the conductor layer and the ground layer.

2 Claims, 9 Drawing Sheets

ARTIFICIAL MAGNETIC CONDUCTOR

CROSS-REFERENCE TO RELATED APPLICATION

This application claims priority to and the benefit of Korean Patent Application Nos. 10-2010-0006191 and 10-2010-0026784 filed in the Korean Intellectual Property Office on Jan. 22, 2010 and Mar. 25, 2010, the entire contents of which are incorporated herein by reference.

BACKGROUND OF THE INVENTION (a) Field of the Invention

The present invention relates to an artificial magnetic conductor. More particularly, the present invention relates to an artificial magnetic conductor having a modified ground layer.

(b) Description of the Related Art

An artificial magnetic conductor is a metamaterial representing a phenomenon that does not generally exist in nature, and has been in the spotlight as core technology that can overcome a physical limitation of existing technology. Such an artificial magnetic conductor has a structure of a surface artificially having characteristics of a magnetic conductor in a specific frequency domain, unlike an electric conductor that can be seen naturally.

The artificial magnetic conductor is formed with an electric conductor. A surface of the artificial magnetic conductor is formed in a protrusion structure to generate a capacitance component and an inductance component. These components can be represented with a frequency function, and surface impedance significantly increases by the components in a specific frequency domain. In a general conductor, surface impedance has a value of "0" and a reflection coefficient has a value of "−1" and thus an image current has an inverse phase, but in an artificial magnetic conductor, surface impedance has a very large value and a reflection coefficient has a value of "+1" and thus an image current has the same phase. Further, propagation of a surface wave can be suppressed due to high surface impedance.

Such a conventional artificial magnetic conductor has a general conductor plate that is not modified as a ground layer. In a conventional artificial magnetic conductor that has a general conductor plate as a ground layer and that is formed in the same grid cell size, in order to lower a frequency domain, a method of increasing capacitance between grid cells or increasing inductance is used. However, when increasing capacitance using grid cells, a frequency bandwidth operating as an artificial magnetic conductor becomes narrow, and when increasing inductance, the size and weight of the artificial magnetic conductor structure increase.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an artificial magnetic conductor structure having advantages of modifying a ground layer of the artificial magnetic conductor according to characteristics of a specific frequency domain, and reducing the size of the artificial magnetic conductor.

An exemplary embodiment of the present invention provides an artificial magnetic conductor including: a conductor layer that is formed in a first direction and that comprises a plurality of grid cells; and a ground layer that is formed in a second direction that is opposite to the first direction and that generates a first frequency, wherein the first frequency is lower than a second frequency of a predetermined artificial magnetic conductor comprising a plurality of grid cells having the same size as that of the plurality of grid cells of the conductor layer and a conductor plate having a form that is not modified.

Another embodiment of the present invention provides an artificial magnetic conductor including: a conductor layer that includes a plurality of grid cells; a ground layer that is formed in a cross form structure to correspond to the conductor layer and that provides a different corresponding surface in the plurality of grid cells by the cross form; and a via that is formed between the conductor layer and the ground layer to electrically connect the conductor layer and the ground layer.

Yet another embodiment of the present invention provides an artificial magnetic conductor including: a conductor layer including a plurality of grid cells; a ground layer that is formed in a structure of a meandering form to correspond to the conductor layer and that provides a different surface corresponding to the plurality of grid cells by the meandering form; and a via that is formed between the conductor layer and the ground layer to electrically connect the conductor layer and the ground layer.

Yet another embodiment of the present invention provides an artificial magnetic conductor including: a conductor layer including a plurality of grid cells; a ground layer that is formed in a structure of a straight-line spiral form to correspond to the conductor layer and that provides a different surface corresponding to the plurality of grid cells by the straight-line spiral form; and a via that is formed between the conductor layer and the ground layer to electrically connect the conductor layer and the ground layer.

DETAILED DESCRIPTION OF THE EMBODIMENTS

Figure 1:
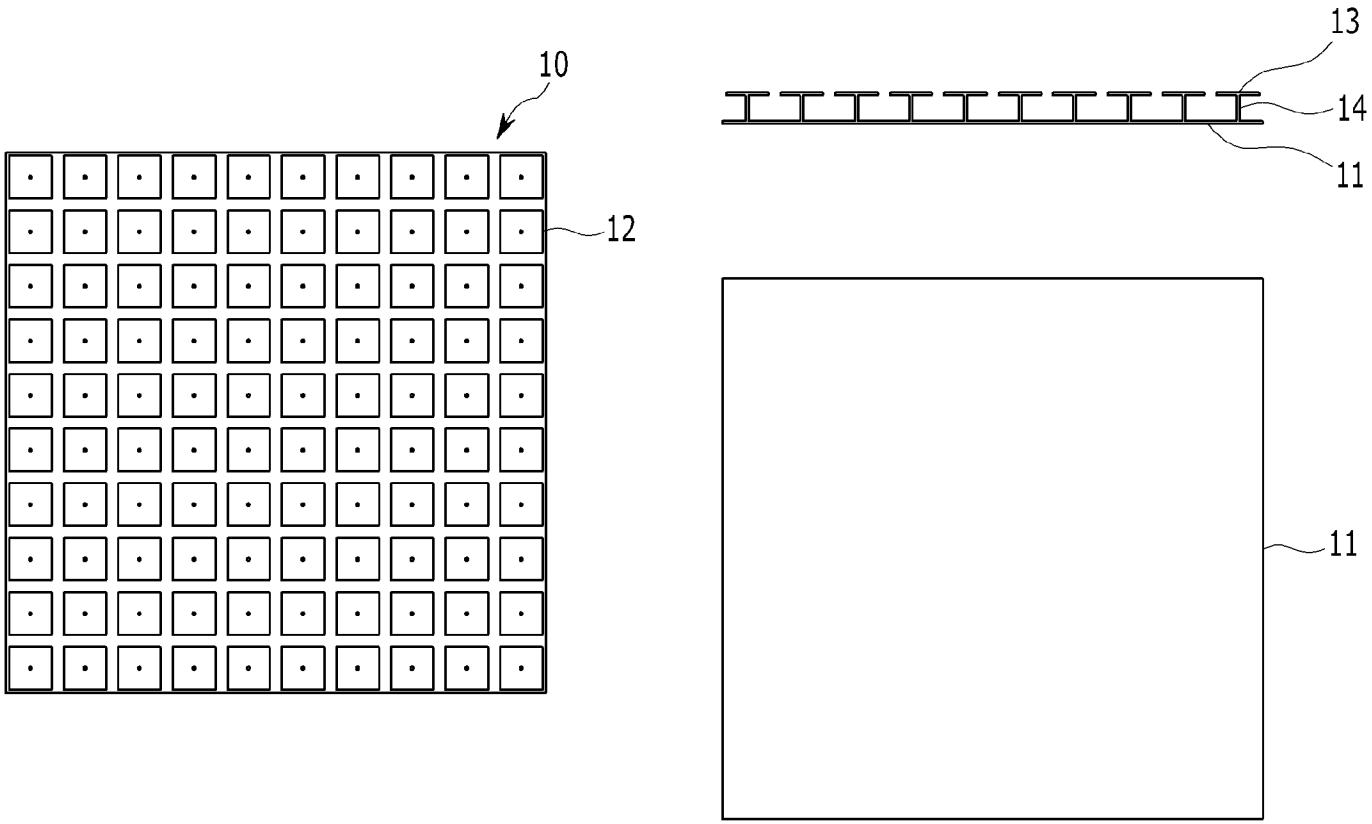
FIG. 1 is a diagram schematically illustrating a general artificial magnetic conductor.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

In addition, in the entire specification, unless explicitly described to the contrary, the word "comprise" and variations such as "comprises" or "comprising" will be understood to imply the inclusion of stated elements but not the exclusion of any other elements.

Figure 2:
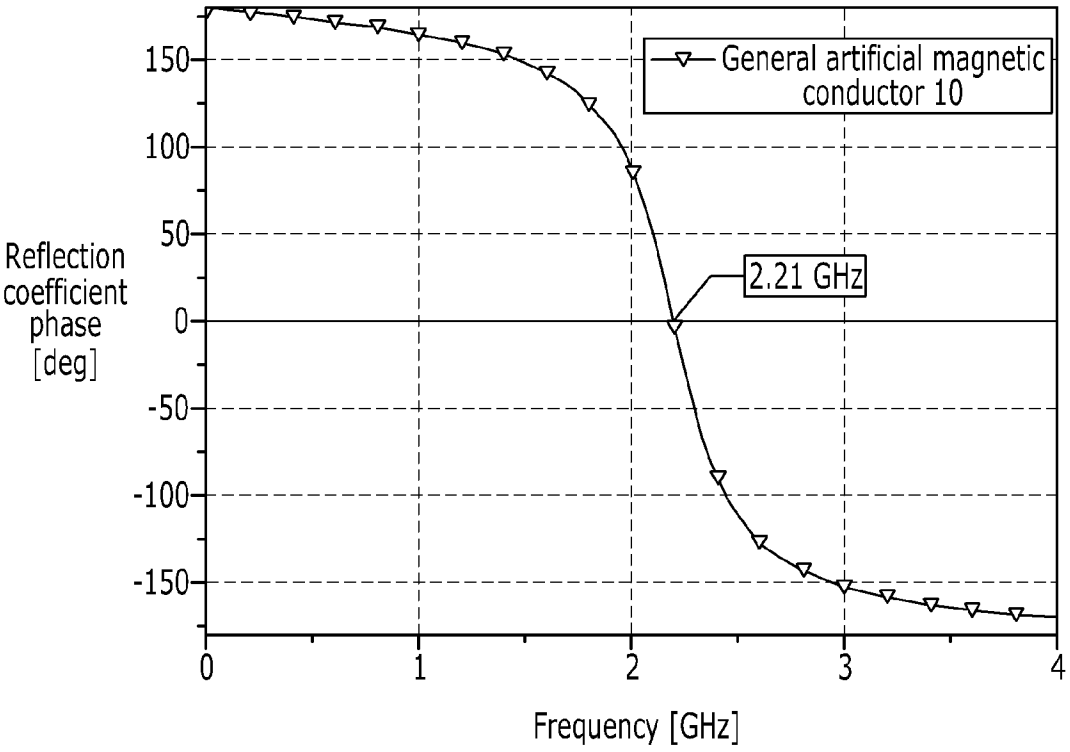
FIG. 2 is a diagram illustrating an example of reflection phase frequency characteristics of the general artificial magnetic conductor of FIG. 1.

FIG. 1 is a diagram schematically illustrating a general artificial magnetic conductor, and FIG. 2 is a diagram illustrating an example of reflection phase frequency characteristics of the general artificial magnetic conductor of FIG. 1.

Referring to FIGS. 1 and 2, a general artificial magnetic conductor 10 includes a ground layer 11, a conductor layer 13 including grid cells 12, and a via 14. As shown in FIG. 2, phase distribution of a reflection coefficient changes according to a change of surface impedance that is generated with a capacitance component and an inductance component between the grid cells 12 of the general artificial magnetic conductor 10. That is, the general artificial magnetic conductor 10 has a property of a complete magnetic conductor in a frequency in which a phase of a reflection coefficient becomes 0°.

The general artificial magnetic conductor 10 has a general conductor plate that is not deformed as the ground layer 11, and lowers a frequency domain by operating as the artificial magnetic conductor 10 in a given size of the grid cells 12, or operates as the artificial magnetic conductor 10 in a specific frequency domain and thus has a limitation in decreasing a size thereof.

Therefore, in the general artificial magnetic conductor 10 having the grid cells 12 of the same size, in order to lower a frequency domain, a method of increasing capacitance between the grid cells 12 or increasing inductance by increasing a distance between the ground layer 11 and the conductor layer 13 is used. However, when increasing capacitance by changing a size of the ground layer 11 and the conductor layer 13, a frequency bandwidth becomes narrow, and when increasing inductance by increasing the distance between the ground layer 11 and the conductor layer 13, the size and weight of the artificial magnetic conductor 10 increase.

In order to solve such a problem, a structure of an artificial magnetic conductor according to an exemplary embodiment of the present invention in which a ground layer of the artificial magnetic conductor is modified in various forms is provided, and will be described in detail with referring to FIGS. 3 to 9.

Figure 3:
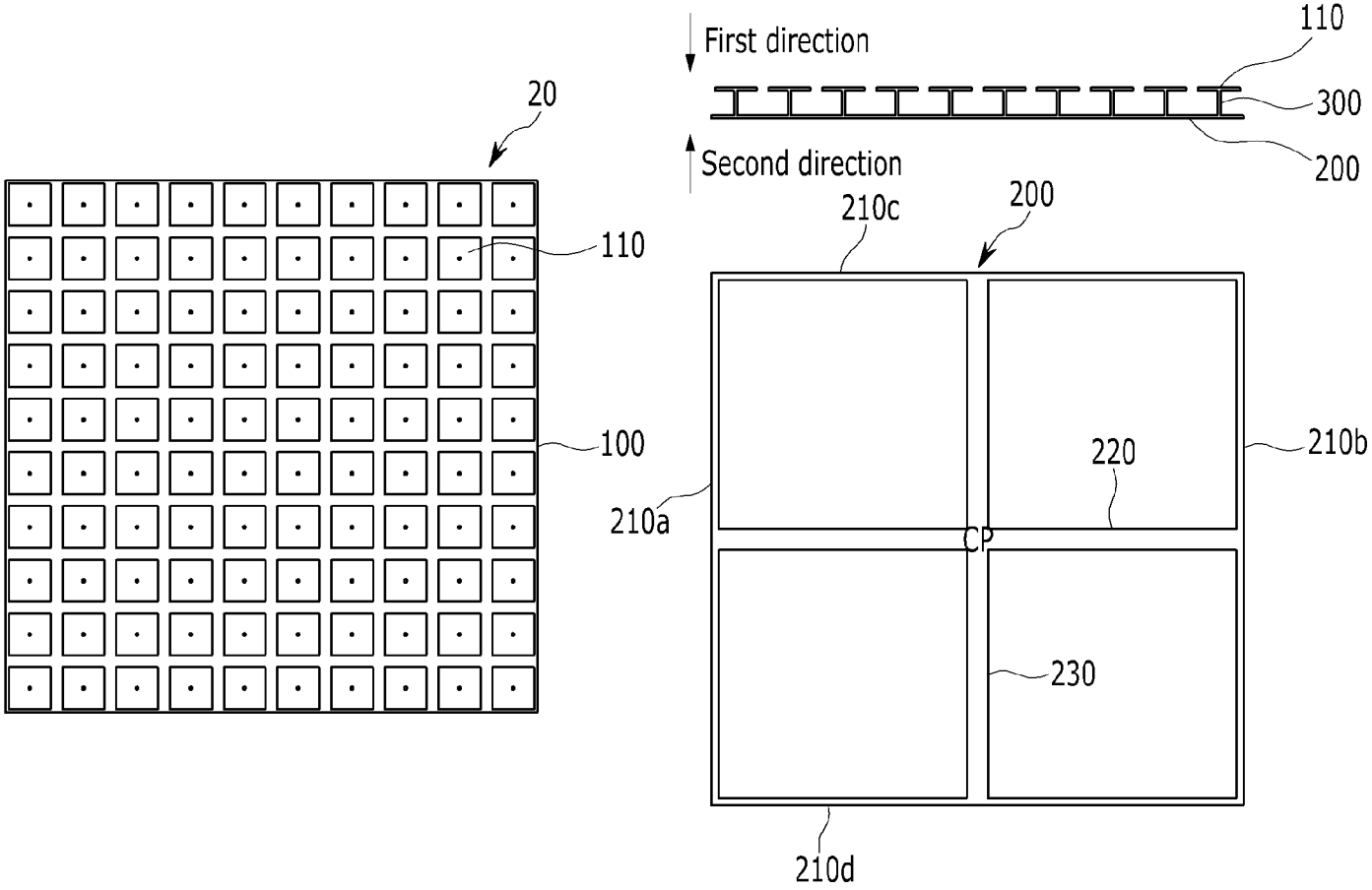
FIG. 3 is a diagram illustrating an example of an artificial magnetic conductor according to an exemplary embodiment of the present invention.
Figure 4:
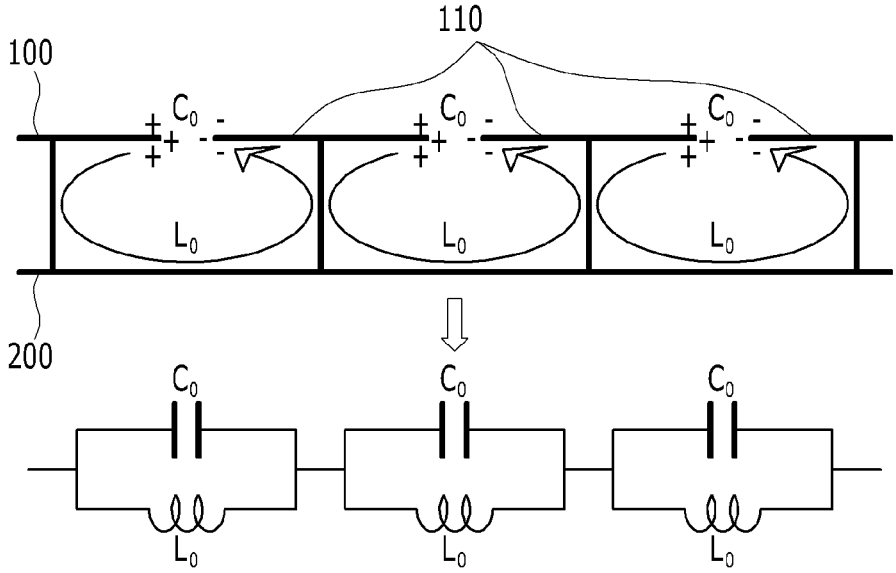
FIG. 4 is a diagram schematically illustrating an equivalent circuit of the artificial magnetic conductor of FIG. 3.
Figure 5:
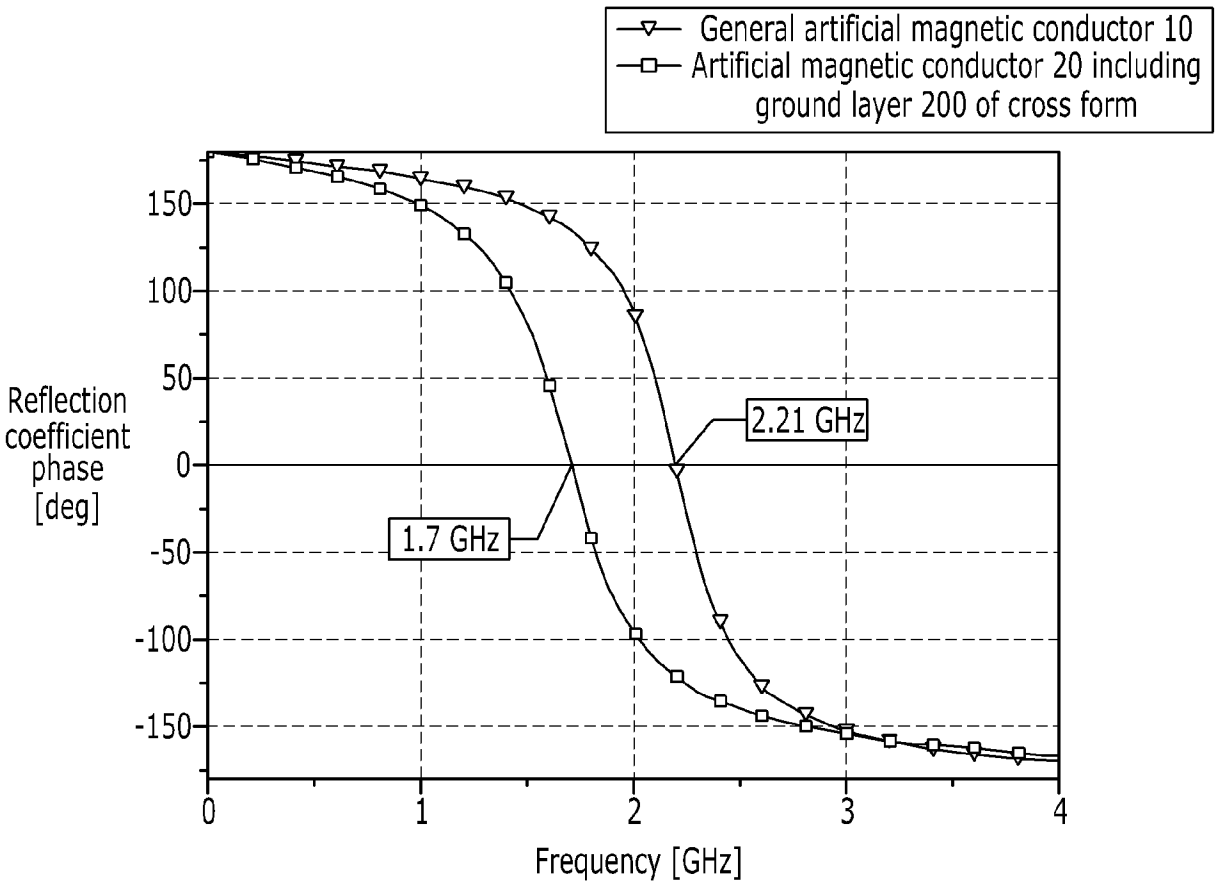
FIG. 5 is a diagram illustrating an example of frequency characteristics of the artificial magnetic conductor of FIG. 3.

FIG. 3 is a diagram illustrating an example of an artificial magnetic conductor according to an exemplary embodiment of the present invention. FIG. 4 is a diagram schematically illustrating an equivalent circuit of the artificial magnetic conductor of FIG. 3, and FIG. 5 is a diagram illustrating an example of frequency characteristics of the artificial magnetic conductor of FIG. 3.

Referring to FIG. 3, an artificial magnetic conductor 20 according to an exemplary embodiment of the present invention includes a conductor layer 100, a ground layer 200, and a via 300.

The conductor layer 100 is positioned in a first direction of the artificial magnetic conductor 20, and includes grid cells 110 having an electrical capacity.

In an exemplary embodiment of the present invention, the size and gap of the grid cells 110 are uniformly formed, but the present invention is not limited thereto, and a size and gap of the grid cells 110 may not be uniformly formed.

The ground layer 200 is positioned in a second direction that is opposite to the first direction of the artificial magnetic conductor 20, and is electrically connected to the grid cells 110 through the via 300. The ground layer 200 has a structure in which the ground layer 11 of the general artificial magnetic conductor 10 that is shown in FIG. 1 is modified in a cross form. Specifically, the ground layer 200 includes frame slots 210*a*, 210*b*, 210*c*, and 210*d* that are formed in a quadrangular form, a first slot 220 that connects the centers of each of the frame slots 210*c* and 210*d*, and a second slot 230 that connects the centers of each of the frame slots 210*a* and 210*b*. In this case, the slot 220 and the slot 230 are connected through a center point CP of the ground layer 200 in a cross form.

The via 300 is electrically connected between the conductor layer 100 and the ground layer 200.

An equivalent circuit of the artificial magnetic conductor 20 can be formed, as shown in FIG. 4, and in the artificial magnetic conductor 20, a capacitance component is generated by proximity between the grid cells 110 that are adjacent to the conductor layer 100, and an inductance component is generated by a loop structure within the grid cells 110. A lattice structure that is formed through the grid cells 110 in the artificial magnetic conductor 20 has resonance characteristics by a capacitance component and an inductance component between the grid cells 110. Surface impedance by a capacitance component C and an inductance component L that are generated in the lattice structure are represented by Equation 1.

$$Z_s = \frac{1}{\frac{1}{j\omega L} + j\omega C} = \frac{j\omega L}{1 - \omega^2 LC} \quad \text{(Equation 1)}$$

Herein, $Z_s$ is surface impedance of the conductor layer 100 that is generated by a lattice structure, C is a capacitance component that is generated in the lattice structure, and L is an inductance component that is generated in the lattice structure.

A reflection coefficient in a surface of the conductor layer 100 is represented by Equation 2, and a phase of a reflection coefficient is represented by Equation 3.

$$|\Gamma| = \frac{Z_s - \eta}{Z_s + \eta} = |\Gamma| e^{j\phi} \quad \text{(Equation 2)}$$

$$\phi = \mathrm{Im}\left\{\ln\left(\frac{Z_s - \eta}{Z_s + \eta}\right)\right\} \quad \text{(Equation 3)}$$

Herein, $\Gamma$ is a reflection coefficient in a surface of the conductor layer 100, $\eta$ is free space impedance, and $\phi$ is a phase of a reflection coefficient.

A frequency bandwidth of the artificial magnetic conductor 20 is defined as a frequency domain having a value within ±90° about a frequency in which a phase of a reflection coefficient is 0°. A frequency in which a phase of a reflection coefficient of the artificial magnetic conductor 20 becomes 0° is represented by Equation 4, and a frequency bandwidth thereof is represented by Equation 5.

$$f_0 = \frac{1}{2\pi\sqrt{LC}} \quad \text{(Equation 4)}$$

-continued $$BW = \frac{1}{\eta}\sqrt{\frac{L}{C}} \quad \text{(Equation 5)}$$

Herein, C is a capacitance component that is generated in the lattice structure, L is an inductance component that is generated in the lattice structure, and η is free space impedance.

Referring to Equation 4, a frequency in which a phase of a reflection coefficient of the artificial magnetic conductor 20 becomes 0° is inversely proportional to an inductance component L and a capacitance component C of the grid cells 110. Therefore, when increasing inductance or capacitance by modifying a structure of the grid cells 110, the frequency can be reduced. However, referring to Equation 5, because a frequency bandwidth of the artificial magnetic conductor 20 is proportional to the inductance component L and is inversely proportional to the capacitance component C, the bandwidth decreases when lowering the frequency so that a phase of a reflection coefficient of the artificial magnetic conductor 20 becomes 0° by increasing the capacitance component C, and when increasing the frequency so that a phase of a reflection coefficient of the artificial magnetic conductor 20 may become 0° by increasing the inductance component L, the bandwidth increases.

If it is assumed that a structure and size of the grid cells 110 that determine the capacitance component C and the inductance component L according to such a lattice structure are the same in the artificial magnetic conductor 20 and the general artificial magnetic conductor 10, as shown in FIG. 5, in the artificial magnetic conductor 20, a frequency in which a phase of a reflection coefficient becomes 0° by the ground layer 200 that is formed in a cross form becomes 1.7 GHz and is smaller than 2.21 GHz, which is a frequency in the ground layer 11 of the general artificial magnetic conductor 10.

Figure 6:
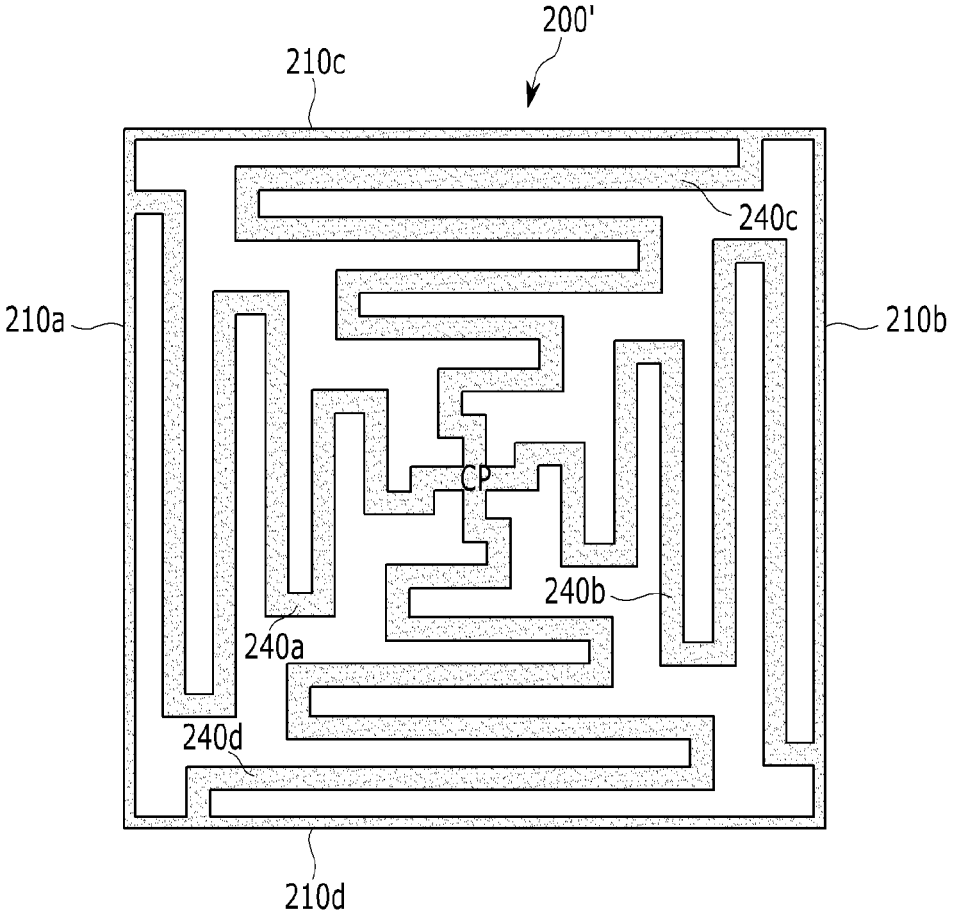
FIG. 6 is a diagram illustrating another example of a ground layer of the artificial magnetic conductor of FIG. 3.
Figure 7:
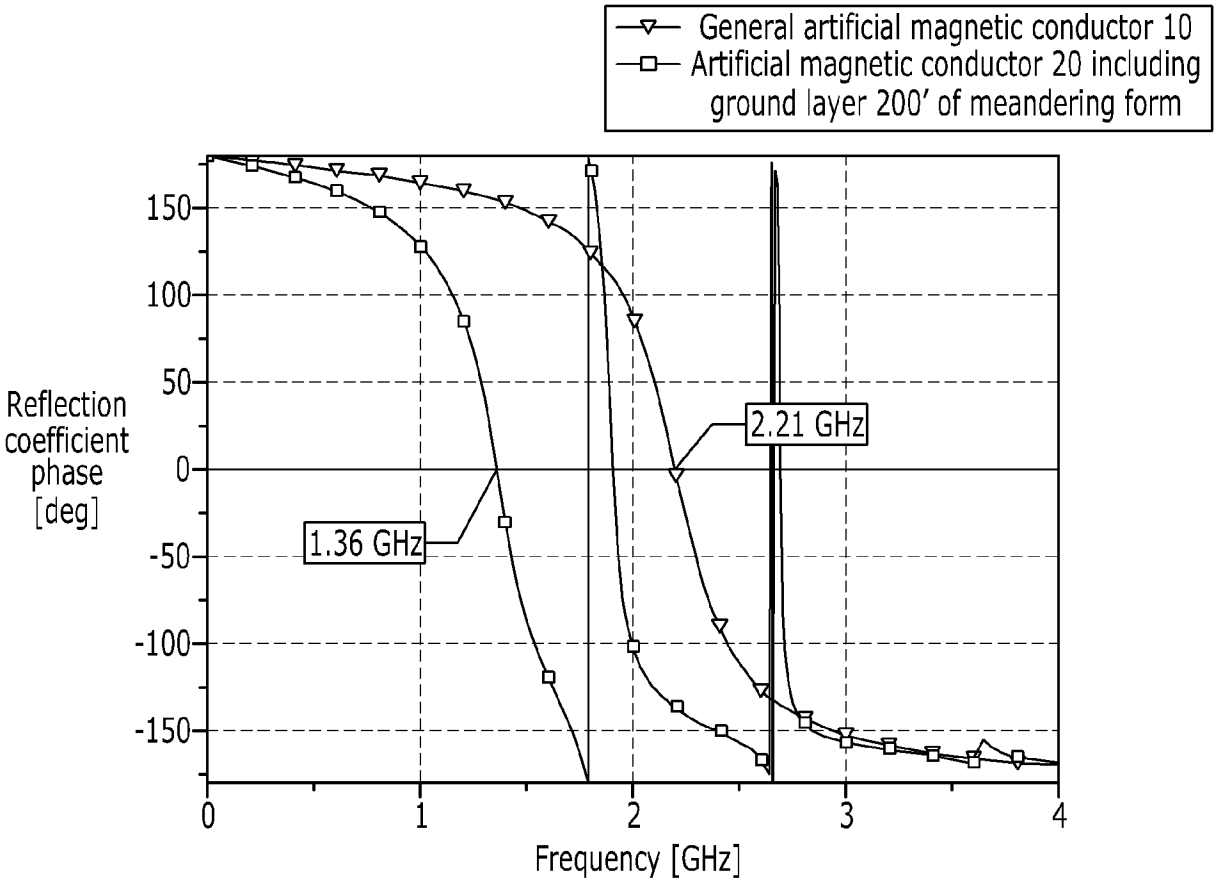
FIG. 7 is a diagram illustrating an example of frequency characteristics of the artificial magnetic conductor of FIG. 6.

FIG. 6 is a diagram illustrating another example of a ground layer of the artificial magnetic conductor of FIG. 3. FIG. 7 is a diagram illustrating an example of frequency characteristics of the artificial magnetic conductor of FIG. 6.

As shown in FIG. 6, a ground layer 200' of the artificial magnetic conductor 20 according to an exemplary embodiment of the present invention is formed in a structure of a meandering form.

The ground layer 200' includes frame slots 210*a*, 210*b*, 210*c*, and 210*d* that are formed in a quadrangular form, and slots 240*a*, 240*b*, 240*c*, and 240*d* of a meandering form. Specifically, the frame slot 210*a* of the ground layer 200' is connected to the slot 240*a* of a meandering form that is connected to a center point CP, the frame slot 210*b* is connected to the slot 240*b* of a meandering form that is connected to the center point CP, the frame slot 210*c* is connected to the slot 240*c* of a meandering form that is connected to the center point CP, and the frame slot 210*d* is connected to the slot 240*d* of a meandering form that is connected to the center point CP. The slot 240*a* and the slot 240*b* are symmetrically formed with the center point CP interposed therebetween, and the slot 240*c* and the slot 240*d* are symmetrically formed with the center point CP interposed therebetween.

In the artificial magnetic conductor 20 including the ground layer 200' of a meandering form, if it is assumed that the structure and size of the grid cells 110 are the same as those in the general artificial magnetic conductor 10, as shown in FIG. 7, in the artificial magnetic conductor 20, the frequency in which the phase of a reflection coefficient becomes 0° becomes 1.36 GHz by the ground layer 200' that is formed in the meandering form and is smaller than 2.21 GHz, which is the frequency in the ground layer 11 of the general artificial magnetic conductor 10.

Figure 8:
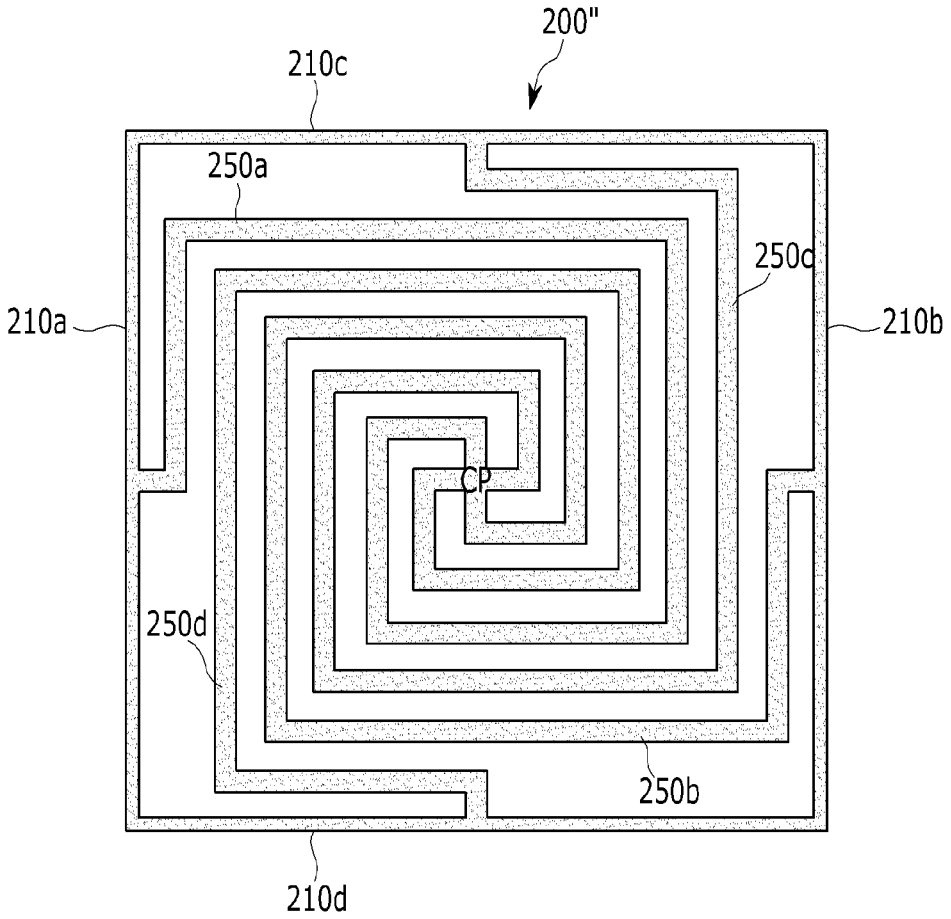
FIG. 8 is a diagram illustrating another example of a ground layer of the artificial magnetic conductor of FIG. 3.
Figure 9:
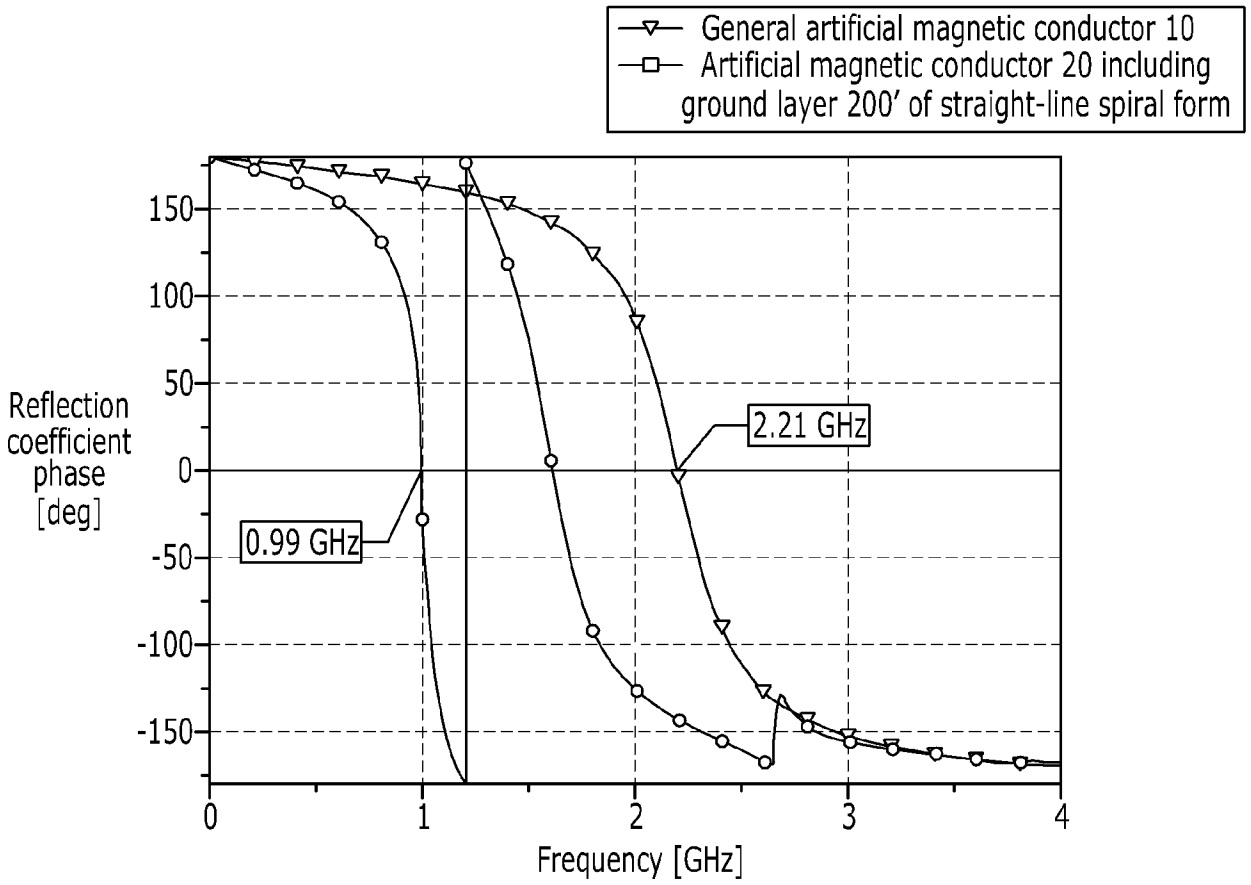
FIG. 9 is a diagram illustrating an example of frequency characteristics of the artificial magnetic conductor of FIG. 8.

FIG. 8 is a diagram illustrating another example of a ground layer of the artificial magnetic conductor of FIG. 3. FIG. 9 is a diagram illustrating an example of frequency characteristics of the artificial magnetic conductor of FIG. 8.

As shown in FIG. 8, a ground layer 200" of the artificial magnetic conductor 20 according to an exemplary embodiment of the present invention is formed in a structure of a straight-line spiral form.

The ground layer 200" includes frame slots 210*a*, 210*b*, 210*c*, and 210*d* that are formed in a quadrangular form, and slots 250*a*, 250*b*, 250*c*, and 250*d* of a straight-line spiral form. Specifically, the frame slot 210*a* of the ground layer 200" is connected to the slot 250*a* of a straight-line spiral form that is connected to a center point CP, the frame slot 210*b* is connected to the slot 250*b* of a straight-line spiral form that is connected to the center point CP, the frame slot 210*c* is connected to the slot 250*c* of a straight-line spiral form that is connected to the center point CP, and the frame slot 210*d* is connected to the slot 250*d* of a straight-line spiral form that is connected to the center point CP.

If it is assumed that the structure and size of the grid cells 110 in the artificial magnetic conductor 20 including the ground layer 200" of the straight-line spiral form are the same as those in the general artificial magnetic conductor 10, as shown in FIG. 9, in the artificial magnetic conductor 20, the frequency in which the phase of a reflection coefficient becomes 0° becomes 0.99 GHz by the ground layer 200' that is formed in the straight-line spiral form and is smaller than 2.21 GHz, which is the frequency in the ground layer 11 of the general artificial magnetic conductor 10.

The ground layer 200 of the artificial magnetic conductor 20 according to an exemplary embodiment of the present invention is formed in a structure of a cross form, a structure of a meandering form, and a structure of a straight-line spiral form, but the present invention is not limited thereto, and the ground layer 200 can have various forms within a range that can be operated with the artificial magnetic conductor 20.

In this way, in an exemplary embodiment of the present invention, by modifying the ground layer 200 in various ways, the artificial magnetic conductor 20 is formed and thus the grid cells can be designed to operate with an artificial magnetic conductor in a lower frequency of the same condition, and a structure operating with an artificial magnetic conductor in a specific frequency can be formed in a smaller size.

According to an exemplary embodiment of the present invention, by modifying a ground layer of grid cells of an artificial magnetic conductor in various forms, inductance can increase and thus a frequency domain operating as the artificial magnetic conductor in the same grid cell size can be lowered.

According to an exemplary embodiment of the present invention, by modifying a ground layer of grid cells of an artificial magnetic conductor in various forms, inductance is increased and thus bandwidth can increase.

Further, according to an exemplary embodiment of the present invention, by modifying a ground layer of grid cells of an artificial magnetic conductor in various forms, improved characteristics such as a low cost, a light weight, a thin thickness, an easy manufacturing process, and heat resistance can be obtained.

An exemplary embodiment of the present invention may not only be embodied through the above-described apparatus and method, but may also be embodied through a program that realizes a function corresponding to a configuration of the exemplary embodiment of the present invention or a recording medium on which the program is recorded.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An artificial magnetic conductor comprising:

a conductor layer comprising a plurality of grid cells;

a ground layer that is formed in a structure of a meandering form to correspond to the conductor layer and that forms different corresponding circuits with the plurality of grid cells by the meandering form, the ground layer including:

a first frame slot;

a second frame slot that is parallel to the first frame slot;

a third frame slot and a fourth frame slot that are perpendicularly connected to the first frame slot and the second frame slot; and a first slot to a fourth slot that form the meandering form and that are connected to the first frame slot to the fourth frame slot, respectively, wherein the first slot and the second slot are symmetrically formed with a center point interposed therebetween, and the third slot and the fourth slot are symmetrically formed with the center point interposed therebetween; and a via that is formed between the conductor layer and the ground layer to electrically connect the conductor layer and the ground layer.

2. An artificial magnetic conductor comprising: a conductor layer comprising a plurality of grid cells; a ground layer that is formed in a structure of a straight-line spiral form to correspond to the conductor layer and that forms different corresponding circuits with the plurality of grid cells by the straight-line spiral form, the ground layer including: a first frame slot; a second frame slot that is parallel to the first frame slot;

a third frame slot and a fourth frame slot that are perpendicularly connected to the first frame slot and the second frame slot; and a first slot to a fourth slot that form the straight-line spiral form and that are connected to the first frame slot to the fourth frame slot, respectively, wherein the first slot and the second slot are symmetrically formed with a center point interposed therebetween, and the third slot and the fourth slot are symmetrically formed with the center point interposed therebetween; and a via that is formed between the conductor layer and the ground layer to electrically connect the conductor layer and the ground layer.

* * * * *